US006232280B1

(12) United States Patent
Shah et al.

(10) Patent No.: US 6,232,280 B1
(45) Date of Patent: May 15, 2001

(54) CLEANING PRODUCT WITH ANALYZABLE AND STABLE SURFACTANT

(75) Inventors: Sayed Sadiq Shah, St. Louis, MO (US); Herb J. Kaiser, Pontoon Beach, IL (US); Shahin Keller, St. Louis, MO (US)

(73) Assignee: Steris Corporation, Mentor, OH (US)

( * ) Notice: Subject to any disclaimer, the term of this patent is extended or adjusted under 35 U.S.C. 154(b) by 0 days.

(21) Appl. No.: 09/310,421

(22) Filed: May 12, 1999

(51) Int. Cl.[7] ..... C11D 3/48; C11D 1/28; C11D 1/34; C11D 9/50

(52) U.S. Cl. ..... 510/179; 510/161; 510/382; 510/390; 510/434; 510/435; 510/436; 510/467

(58) Field of Search ..... 510/161, 179, 510/382, 390, 434, 435, 436, 467

(56) References Cited

U.S. PATENT DOCUMENTS 4,485,028 * 11/1984 King ..... 252/99
5,143,562 * 9/1992 Boulos ..... 148/247
5,858,941 * 1/1999 Oakes et al. ..... 510/179

OTHER PUBLICATIONS

Formulation Science, vol. 1, Proceedings from Formulations Forum '97, pp. 246–247 (Association of Formulation Chemists 1997), No Month Given.

Harcros Organics Literature: T–MULZ® Phosphate Esters (Aug. 15, 2000).

DeForest website (www.deforest.net/htms/hydrotro.htm) (Aug. 15, 2000).

Dow Chemical Company website (www.ajtsc.com/dow.htm) (Aug. 15, 2000).

Material Safety Data/Fiche Signaletique: RHODAFAC BP–769; Rhone–Poulenc Canada, Inc. Sep. 13, 1994.

T–MULZ Emulsifiers: T–MULZ 211; Harcros Organics (1995), No Month Given.

* cited by examiner

*Primary Examiner*—Yogendra Gupta
*Assistant Examiner*—Brian P. Mruk
(74) *Attorney, Agent, or Firm*—Fay, Sharpe, Fagan, Minnich & McKee, LLP

(57) ABSTRACT

A cleaning composition includes a detectable substance which is relatively stable in the cleaning composition, for indicating whether the cleaning composition has been thoroughly removed from a vessel following a cleaning process. For pharmaceutical applications, the detectable substance is preferably a low-foaming surfactant that is detectable by high performance liquid chromatography at concentrations of around 10 ppm, or less. The surfactant is thus detectable in the same analytical procedure as are traces of pharmaceutical residues which have not been removed from the vessel. The analytical procedure is used to develop a cleaning protocol for future cleaning processes by determining the number of rinses needed for reducing the surfactant, and hence the cleaning product, and also the pharmaceutical residues, in the rinse water to predetermined acceptable levels.

9 Claims, 1 Drawing Sheet

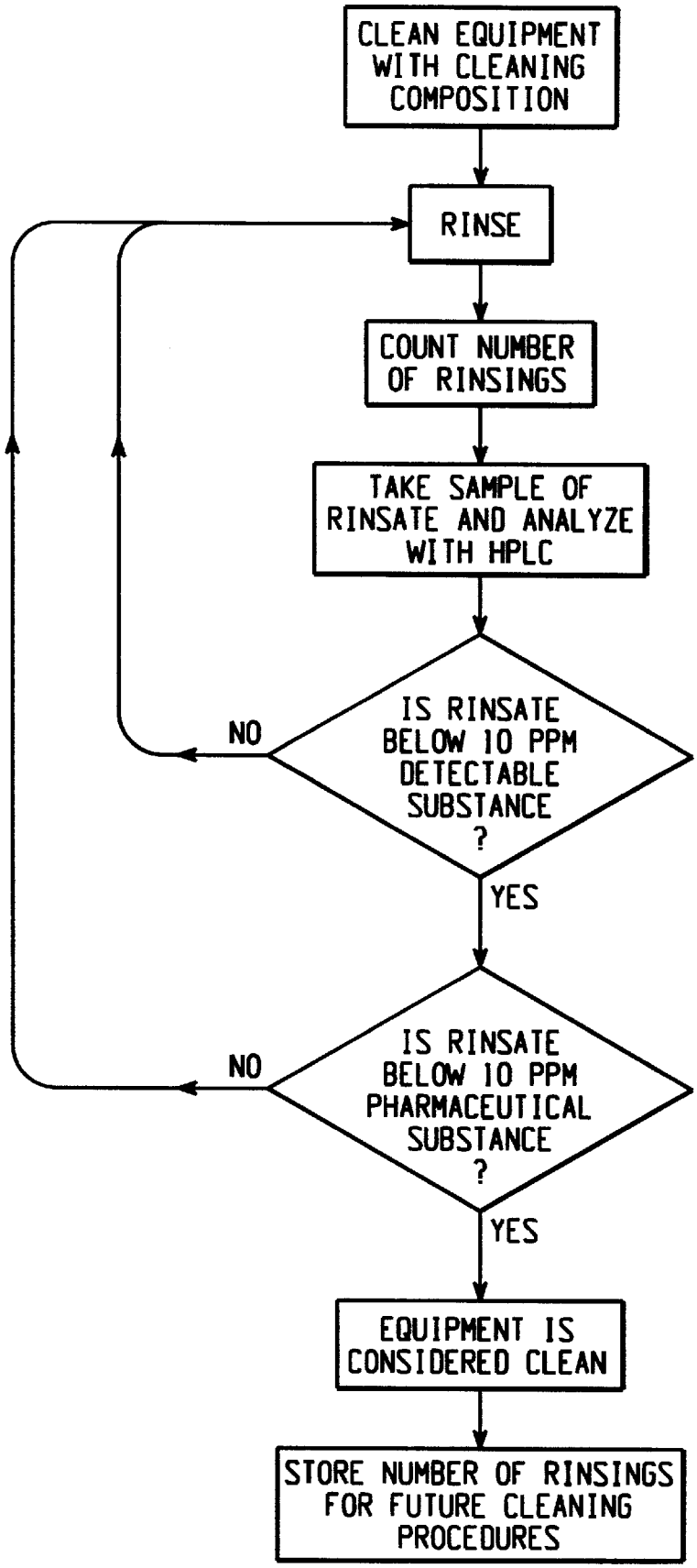
CLEAN EQUIPMENT WITH CLEANING COMPOSITION
RINSE
COUNT NUMBER OF RINSINGS
TAKE SAMPLE OF RINSATE AND ANALYZE WITH HPLC
IS RINSATE BELOW 10 PPM DETECTABLE SUBSTANCE ?
NO
YES
IS RINSATE BELOW 10 PPM PHARMACEUTICAL SUBSTANCE ?
NO
YES
EQUIPMENT IS CONSIDERED CLEAN
STORE NUMBER OF RINSINGS FOR FUTURE CLEANING PROCEDURES

CLEANING PRODUCT WITH ANALYZABLE AND STABLE SURFACTANT

BACKGROUND OF THE INVENTION

The present invention relates to the cleaning arts. It finds particular application in conjunction with the detection of residual cleaning products remaining on pharmaceutical processing equipment after cleaning, and will be described with particular reference thereto. It should be appreciated, however, that the invention is also applicable to a variety of cleaning applications where it is desirable to ensure that the cleaning product has been thoroughly removed before reuse of the equipment.

Industries such as the pharmaceutical industry clean tanks and other processing equipment with detergent-based cleaners to remove traces of the products processed in the equipment. For pharmaceutical applications, in particular, it is important to ensure that the cleaning process has effectively removed drugs and cleaning product residues from the equipment so that there will be no cross contamination from one batch of the product to another and therefore no physiological impact. The Food and Drug Administration requires that tests be conducted to validate the cleaning process.

The level of residual cleaning product remaining on the equipment after cleaning is commonly determined by a non-specific analytical method, such as Total Organic Carbon (TOC) analysis. This approach is limited in that it only offers information about the water-soluble carbon content of all components in the residue and not about specific components in the cleaning product.

Currently, High Performance Liquid Chromatography (HPLC) is the method of choice for determining the level of residual pharmaceutical product on the equipment. The HPLC decive is calibrate using a sample of one or more of the drug additives processed in the pharmaceutical equipment. A sample of residue extracted from a wall of the processing tank, or other part of the equipment, is compared with the calibrated sample and the remaining level of pharmaceutical residue determined.

The HPCL technique is a highly sensitive method of detecting specific components in the residue. However, the detecting has not been used for detecting traces of the cleaning product on the equipment. Most components of cleaning products do not contain a detectable species, or chromophore, which can be detected by the HPLC. Moreover conventional surfactants used in the cleaning products tend to degrade over time due to the highly alkaline or acidic pH of the cleaning product and thus are not capable of acting as stable indicators for the cleaning product.

The present invention provides a new and improved cleaning composition and method for detection of residual cleaning composition after cleaning which overcomes the above-referenced problems and others.

SUMMARY OF THE INVENTION

In accordance with one aspect of the present invention, a method of evaluating a surface for removal of a cleaning composition after a cleaning process, the cleaning composition including a detectable substance which is stable in the cleaning composition is provided. The method includes rinsing the surface to produce a rinsate which contains the detectable substance to provide an indication of whether the cleaning composition has been removed from the surface to at least a maximum acceptable level.

In accordance with another aspect of the present invention, a cleaning composition for cleaning a residue from a surface is provide. The composition includes a detectable substance which is stable in the cleaning composition and which is detectable at a concentration of about 10 ppm or less.

In accordance with another aspect of the present invention, a cleaning composition for cleaning a residue from a surface is provided. The composition includes, in terms of weight percent:

| | |
|---|---|
| an anti-redeposition agent | 1–10; |
| a strong alkali | 9–50; |
| a chelating agent | 1.0–10.0; |
| a surfactant | 0.2–5; and |
| water | Q.S. |

The surfactant is one which is detectable at a concentration of 10 ppm or below for serving as an indicator of whether the cleaning product has been removed from the surface.

In accordance with another aspect of the present invention, a method for determining whether a piece of equipment has been rinsed sufficiently to remove a process residue and a cleaning composition used in cleaning the process residue from the equipment is provided. The method includes spectroscopically analyzing a rinsate from the equipment at a first selected wavelength to determine whether a preselected component of the process residue is above a minimum preselected level and spectroscopically analyzing the rinsate at a second selected wavelength to determine whether a spectroscopically detectable substance in the cleaning composition is above a minimum preselected level.

One advantage of the present invention is the provision of a cleaning composition which includes a detectable component for assessing whether the cleaning product has been thoroughly rinsed from the equipment being cleaned.

Another advantage of the present invention is that the detectable component may be detected by HPLC.

Yet another advantage of the present invention is that it enables residual cleaning product to be detected by the same method as is conventionally used for detecting pharmaceutical residues.

A further advantage of the present invention is the provision of a surfactant for a cleaning product which is detectable at extremely low levels and is stable at strong pH.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawing is only for purposes of illustrating a preferred embodiment and is not to be construed as limiting the invention.

The FIGURE is a schematic diagram of a flowpath for testing pharmaceutical equipment for residues according to the present invention.

DETAILED DESCRIPTION OF THE PREFERRED EMBODIMENTS

A cleaning composition for removing pharmaceutical materials from processing equipment includes a detectable substance, preferably a stable surfactant, for evaluating the level of cleaning composition remaining on the processing equipment after cleaning.

With reference to FIG. 1, a cleaning process includes cleaning a piece of pharmaceutical equipment by contacting the equipment with the cleaning composition to remove pharmaceutical residues and other contaminants from surfaces of the equipment. The cleaning composition may be used neat, without further dilution, but is preferably diluted with water, or other solvents, to form a solution of the cleaning composition. The cleaning step optionally includes spraying, or otherwise impacting surfaces of the pharmaceutical equipment with the cleaning composition or diluted cleaning solution to provide physical as well as chemical cleaning.

The surfaces are then rinsed a number of times with water, or other suitable solvent to remove traces of the residue and the cleaning composition from the equipment. A sample of the final rinse is analyzed by an analytical method to determine whether the concentrations of the detectable substance and specific components of the pharmaceutical residue are below a predetermined, acceptable level. The concentration of the detectable substance is used as an indicator of the level of the cleaning composition in the rinsate and as an indication of whether the cleaning fluid has been removed from the equipment. A concentration of the detectable substance which is above the acceptable level indicates that the rinsing process has not been satisfactory and that traces of the cleaning product above an acceptable level are likely to remain on the equipment. A concentration of the detectable substance which is at or below the acceptable level indicates that the rinsing process has been satisfactory and that traces of the cleaning product at or below an acceptable level are likely to remain on the equipment.

If either the concentration of the detectable substance or the concentration of the residue component in the rinsate is above the acceptable level, the equipment is subjected to one or more additional rinses and the final rinsate is retested. The procedure is continued until acceptable levels of the detectable substance and pharmaceutical residue component are measured. The equipment is then ready for processing pharmaceutical products without the risk of contamination by the cleaning composition or the components of the pharmaceutical residue.

The total number of rinses used to clean the equipment to the acceptable levels is then recorded and may be used in future cleaning cycles which use the same cleaning composition to remove the same pharmaceutical residue.

The number of rinses needed for cleaning the equipment varies with the pharmaceutical products and the cleaning composition used. Pharmaceutical products include components of differing toxicity or adverse combination effects when carried over in the equipment to a different product formulation. Thus, the acceptable level of each component varies, and the number of rinses needed to achieve a safe level may vary accordingly. Some pharmaceutical components are more difficult to remove than others, which also affects the number of rinsings. Components of the cleaning compositions, particularly surfactants, adhere to the equipment to differing extents and thus affect the number of rinses required to thoroughly remove the cleaning product. For each combination of pharmaceutical product manufactured and cleaning composition used to remove it, therefore, there will be a preferred number of rinses to ensure thorough cleaning. Once the number of rinses has been established for a particular piece of processing equipment and a particular combination of pharmaceutical product and cleaning composition, it can be used for future cleaning cycles. The equipment is preferably recalibrated at intervals to ensure that thorough cleaning continues to be achieved.

The detectable substance is preferably one which is readily detectable by conventional methods used to detect components of pharmaceutical residues. Since HPLC is the preferred method of detecting pharmaceutical components at low levels, the detectable substance is preferably also detectable by HPLC. HPLC uses a combination of chromatography for separating the rinsate into components, and UV/visible spectroscopy at a fixed wavelength, dependent on the component to be analyzed. The HPLC is thus set to detect for signals at two (or more) wavelengths, one corresponding to a known component of the pharmaceutical product or other chemical expected to be left in the equipment after processing, and one corresponding to the detectable substance.

While HPLC is a preferred method of analysis since it is able to detect concentrations of 1%, or below, in the rinsate, other methods are also contemplated for detecting the detectable substance, such as electrochemical methods and fluorescence. In an electrochemical method, an applied voltage would correspond to the oxidation or reduction potential of a particular functional group of the detectable substance. The current flowing at that voltage would then be used to determine the concentration. In a fluorescence method, the detectable substance would contain a fluorescing group, detectable by a spectroscopic technique. Simple UV/visible spectroscopy could also be used (without the HPLC chromatographic column).

The detectable substance thus contains a species, (termed a chromophore, in the case of HPLC or other UV/visible detection method), which is detectable at low levels by the method of analysis used. The FDA requires that the cleaning composition be removed to a level of 10 ppm in the final rinse, or lower. Accordingly, the detectable substance is preferably detectable at around 10 ppm, or lower, more preferably at a level of around 1 ppm or below.

The detectable substance should also be stable in the cleaning composition. Cleaning compositions tend to be highly alkaline (around pH 10–14) or highly acidic (around pH 1–2) and thus many substances which include chromophores are hydrolyzed in the strong pH. Because of this, the concentration in the cleaning composition tends to diminish over time and thus the level of the detectable substance detected is not representative of the concentration of the cleaning composition in the rinsate. For example, a mixed amphocarboxylate surf actant with eight carbon chains was found to be unstable in an alkaline cleaning product, decreasing in concentration, due to hydrolysis, from 1.83% in the cleaning product at 6 days after manufacture to 0.82after 41 days and 0.09% after 141 days and thus could not be considered a stable surfactant. Preferred detectable substances are stable at strong pH, i.e., either high pH (pH 1–2) and/or low pH (pH 10–14). Most preferably, the surfactants are stable at both high and low pH and are stable at around pH 1 and at around pH 14.

By stable, it is meant that the surfactant does not appreciably degrade (i.e., the detectable substance does not degrade and become undetectable) over the expected storage lifetime of the cleaning composition. Storage times of cleaning compositions (the time between manufacture and use) are usually less than about three months, so the detectable substance should be stable for about three months, or longer. Preferably, no more than 10–20%, and more preferably no more than 5% of the detectable substance degrades in a period of three months. Conventional cleaning compositions tend to be alkaline, and thus detectable substances which are stable at high pH (pH 10–14, and more preferably up to pH 13–14) are particularly preferred. Of course, such substances may be stable at both high and low pH.

Preferably, the detectable substance is at least as difficult to remove from the walls of the equipment as other components of the cleaning composition. For this purpose, surfactants are considered to be suitable detectable substances, because they tend to adhere to the walls, taking several rinses to remove them. However, conventional surfactants generally used in cleaning compositions do not have all of the properties desired in a detectable substance, including stability and detectability at low levels.

For pharmaceutical applications in particular, the detectable substance, in the case of a surfactant, is low foaming. For other applications, such as in washers, moderate, or even high foaming surfactants may not pose a problem, or may be preferred. By low foaming, it is meant that the surfactant generates an average foam height of about 40 mm, or less, on shaking (after 0 minutes standing), more preferably, around 30 mm, or less, in the temperature range of 25–60° C. By moderate foaming, it is meant that the surfactant generates an average foam height of about 40–70 mm. High foaming means a foam height of 70 mm and above. Foam height is the height of foam standing above the top of the solution.

To make the foam height measurements, a surfactant formulation was prepared, as follows.

| Component | % |
|---|---|
| surfactant | 0.55 (active) |
| KOH | 22.5 |
| octyl betaine | as needed to couple surfactant into solution |
| water | Q.S. |

A 1.6 mL sample of the surfactant formulation was further diluted to a volume of S0mL with deionized water in a 250 mL graduated shaker flask. The flask was shaken for 1 minute and measurements of foam height were taken at 0, 5, 10, and 15 minutes after the shaking was complete.

Measurements were made at 25°, 40°, and 60° C. Preferred detectable substances are surfactants which are both detectable and stable at either high and/or low pH. Examples of stable surfactants which are detectable at a low levels and stable include phosphate esters, aryl sulfonates, and aryl disulfonates. Each of these surfactants includes at least one stable functional group which is detectable at low levels.

Examples of suitable phosphate esters are aromatic phosphate esters of the general formula:

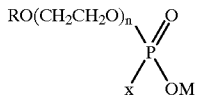

where X is $RO(CH_2CH_2O)_n$ or OM;

M is an alkali metal, such as Na or K;

R includes an alkyl or phenyl group and preferably includes from 8–18 carbon atoms; and n=2–10, preferably over 6, with a preferred distribution of about 7–18 carbons, preferably 8–17 carbons.

These phosphate ester species are good anionic surfactants. They are stable over an extended period of time (less than 5% reduction in concentration detected over 3 months) and detectable at concentrations of well below 10 ppm, sometimes at around 1 ppm or below.

Preferred phosphate esters in which X is $RO(CH_2CH_2O)_n$ include: poly (oxy-1,2-ethanediyl), alpha-phenyl-omega-hydroxy phosphate obtainable under the trade name Rhodafac BP-769, and polyethoxylated polyarylphenol phosphate, obtainable under the trade name Soprophor 3D33, both obtainable from Rhone-Poulenc. Another preferred phosphate ester is obtainable under the trade name T-MULZ 211 from Harcross, and is similar to Rhodafac BP-769. Rhodafac BP-769 and T-MULZ 211 were found to be detectable at around 1 ppm, or below. The Rhodafac BP-769 and the T-MULZ 211 surfactant products are also low foaming, while the Soprophor 3D33 is moderate foaming. In stability tests carried out over a three month period, both Rhodafac BP-769 (at 1% by weight of the composition) and T-MULZ 211 (at 0.5% and at 1% by weight of the composition) were found to be stable in the composition with no appreciable change in the measured concentration of the surfactant in the composition over that time (much less than 5% drop in concentration).

Preferred aryl sulfonates include alkylnapthalene sulfonates of the general formula:

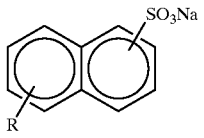

which are obtainable from PETRO under the trade name Petro ULF. This product is low foaming. Sulfonates of this type have good stability, but the sulfonate chromophore detection limit tends to be higher than that of the phosphate ester chromophore. However, concentrations of 2 ppm, and below are readily detectable.

Preferred aryl disulfonates include diphenyl oxide disulfonates of the general formula:

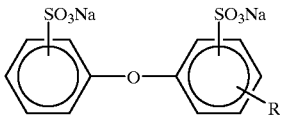

where R is a long chain olef in, preferably with 8–18 carbon atoms, more preferably around 16 carbon atoms.

An example of a suitable disulfonate is a C16 α olef in-based diphenyl oxide disulfonate, obtainable under the trade name Dowfax 8390 from Dow Chemicals. It has good stability and it is detectable at around 1%, however it is high foaming, and thus is less suited to some pharmaceutical applications.

The cleaning composition can be acidic or alkaline. A suitable alkaline formulation includes 9–50% by weight of a strong alkali, such as sodium or potassium hydroxide. The composition also includes the detectable substance and water. Potassium hydroxide at a concentration of 18–25% is preferred, with a particularly preferred concentration of about 21% by weight potassium hydroxide.

When the detectable substance is a surfactant, selected from the surfactants described above, it is preferably present in the cleaning composition at a concentration of from 0.2 to 5%, more preferably at a concentration of 0.2–1%, and most preferably at around 0.5–1% by weight of the cleaning composition.

The composition preferably also includes a chelating agent for chelating with water hardness salts, such as salts of calcium and magnesium, deposited on the equipment to be cleaned. Suitable chelating agents include, but are not limited to, carboxylic acid-based polymers, such as polyacrylic acid, and ethylenediaminetetraacetic acid (EDTA) or salts thereof.

The chelating agent or agents may be present at a concentration of 1.0–10.0% by weight, more preferably from 2–6%. A preferred composition includes 2–6%, more preferably about 3.8% by weight of Na-EDTA, and 0.1–3%, more preferably about 0.3% by weight of polyacrylic acid.

The composition may also include an anti-redeposition agent, which inhibits redeposition of soil on the equipment. Suitable anti-redeposition agents include gluconates, such as sodium gluconate, and citrate salts. Polyacrylic acid also acts as an anti-redeposition agent. The anti-redeposition agent is preferably at a concentration of 1–10%, more preferably 3–8%, and most preferably about 5–6% by weight of the composition. A particularly preferred composition includes polyacrylic acid at a concentration of 0.1–3%, more preferably about 0.3% by weight, and sodium gluconate at a concentration of 1–10%, more preferably about 5% by weight of the composition.

A preferred alkaline cleaning composition includes:

| Component | % by weight |
|---|---|
| Strong Alkali | 9–50 |
| Detectable substance | 0.2–5 |

-continued

| Component | % by weight |
|---|---|
| Chelating agent | 1–10 |
| anti-redeposition agent | 1–10 |
| Water | Q.S. |

A more preferred alkaline composition includes: A yet more preferred composition includes:

| Component | % by weight |
|---|---|
| Sodium or Potassium Hydroxide | 18–25 |
| Chelating Agent (such as Na-EDTA) | 2–5 |
| Anti-redeposition agent (such as gluconates, citrates, carboxylic acid-based polymers) | 3–8 |
| Aromatic phosphate ester | 0.5–1 |
| Water | Q.S. |

One particularly preferred alkaline composition includes:

| Component | % by weight |
|---|---|
| Potassium Hydroxide | 18–25 |
| Sodium EDTA | 2–5 |
| Sodium gluconate | 3–8 |
| Polyacrylic acid | 0.1–2 |
| Aromatic phosphate ester | 0.2–5 |
| Water | Q.S. |

A more particularly preferred alkaline composition includes:

| Component | % by weight |
|---|---|
| Sodium gluconate | 5 |
| Potassium Hydroxide | 21 |
| Sodium EDTA | 3.8 |
| Polyacrylic acid | 0.3 |
| T-MULZ or Rhodafac | 0.5 |
| Water | Q.S. |

Acidic formulations may be analogously formed by replacing the alkali in the formulation with a strong acid, such as phosphoric acid.

While in no ways wishing to limit the scope of the present invention, the following example shows the foaming characteristics of various surfactants.

EXAMPLE

Foaming Characteristics of Surfactants

Foam heights of various surfactants were measured according to the method described above. Table 1 lists the % octyl betaine needed to couple the surfactant and foam heights measured after 0, 5, 10, and 15 minutes at temperatures of 25°, 40°, and 60° C.

TABLE 1

| Foam Heights of Surfactants | | | | | | | |
|---|---|---|---|---|---|---|---|
| Surfactant | % Octyl betaine | Minutes | 25° C. | 40° C. | 60° C. | Average | Classification |
| Dowfax 8390 | 3.0 | 0 | 50 | 60 | 80 | 63 | Moderate Foaming |
| | | 5 | 36 | 40 | 40 | 39 | |
| | | 10 | 34 | 38 | 30 | 34 | |
| | | 15 | 32 | 34 | 18 | 28 | |
| Petro ULF | 6.0 | 0 | 36 | 24 | 34 | 31 | Low Foaming |
| | | 5 | 18 | 18 | 10 | 15 | |
| | | 10 | 18 | 14 | 8 | 13 | |
| | | 15 | 16 | 10 | 6 | 11 | |
| Rhodafac BP-769 | 0.0 | 0 | 30 | 30 | 26 | 29 | Low Foaming |
| | | 5 | 0 | 0 | 0 | 0 | |
| | | 10 | 0 | 0 | 0 | 0 | |
| | | 15 | 0 | 0 | 0 | 0 | |
| Soprophor 3D33 | 4.0 | 0 | 40 | 40 | 46 | 42 | Moderate foaming |
| | | 5 | 30 | 26 | 28 | 28 | |
| | | 10 | 30 | 26 | 20 | 25 | |
| | | 15 | 20 | 24 | 14 | 19 | |

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A cleaning composition for cleaning a residue from a surface, the composition comprising:

a detectable surfactant as a sole surfactant in the cleaning composition, which is stable in the cleaning composition and which is detectable at a concentration of about 10 ppm or less, the surfactant being selected from the group consisting of phosphate esters, aryl sulfonates, and aryl disulfonates; and 18–25% by weight of a strong alkali selected from the group consisting of sodium hydroxide, potassium hydroxide, and combinations thereof.

2. The composition of claim 1, wherein the surfactant is a phosphate ester of the general formula:

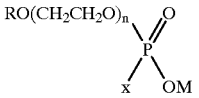

where X is $RO(CH_2CH_2O)_n$ or OM,

M is an alkali metal,

R includes an alkyl or phenyl group, and n is from 2 to 10.

3. The composition of claim 2, wherein the phosphate ester is selected from the group consisting of poly (oxy-1, 2-ethanediyl), alpha-phenyl-omega-hydroxy phosphate, and polyethoxylated polyarylphenol phosphate.

4. The composition of claim 1, wherein the surfactant is low foaming.

5. The composition of claim 1 further including at least one anti-redeposition agent or chelating agent selected from the group consisting of gluconates, citrates, EDTA and salts thereof, and carboxylic acid-based polymers.

6. The composition of claim 5, wherein the chelating agent includes EDTA or a salt thereof at a concentration of 1–10% by weight of the composition and the anti-redeposition agent includes sodium gluconate at a concentration of 1–10% by weight of the composition and a polyacrylic acid at a concentration of 0.1–2.0% by weight of the composition.

7. A cleaning composition for cleaning a residue from a surface, the composition comprising, in terms of weight percent:

| | |
|---|---|
| an anti-redeposition agent | 1–10; |
| a strong alkali | [at least] 18–50; |
| a chelating agent | 1.0–10.0; |
| a surfactant | 0.2–5; and |
| water | Q.S.; |

the surfactant being one which is detectable at a concentration of 10 ppm or below for serving as an indicator of whether the cleaning product has been removed from the surface as a sole surfactant in the cleaning composition, the surfactant being selected from the group consisting of phosphate esters, aryl sulfonates, and aryl disulfonates.

8. The cleaning composition of claim 7, wherein the composition includes, in terms of weight percent:

| | |
|---|---|
| sodium gluconate | 3–8; |
| potassium hydroxide | 18–25; |
| sodium EDTA | 2–5; |
| polyacrylic acid | 0.1–2; |
| an aromatic phosphate ester | 0.2–1; and, |
| water | Q.S. |

9. The cleaning composition of claim 7, wherein the surfactant is detectable by high performance liquid chromatography at a concentration of about 1 ppm, or below.

* * * * *